US006422188B2

(12) United States Patent
Pierik

(10) Patent No.: US 6,422,188 B2
(45) Date of Patent: Jul. 23, 2002

(54) ACTUATOR FOR VARIABLE VALVE MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/759,869

(22) Filed: Jan. 12, 2001

Related U.S. Application Data

(60) Provisional application No. 60/176,131, filed on Jan. 14, 2000.

(51) Int. Cl.[7] ..... F01L 1/34

(52) U.S. Cl. ..... 123/90.17; 123/90.31; 74/568 R; 464/2; 464/160

(58) Field of Search ..... 123/90.15, 90.17, 123/90.31; 74/568 R; 464/1, 2, 160

(56) References Cited

U.S. PATENT DOCUMENTS 5,172,662 A * 12/1992 Hampton ..... 123/90.17
6,192,842 B1 * 2/2001 Haag ..... 123/90.17
6,213,882 B1 * 4/2001 Okada et al. ..... 464/77

OTHER PUBLICATIONS

"formsprag—Form–Lock Bi–Directional Driving/Backstopping", Warner Electric Manufacturing Catalogue, Dana Publishing, pp. 1–2, (Dec. 21, 1992).

"RL Series Reverse–Locking Clutches", Warner Electric Manufacturing Catalogue, Dana Publishing, pp. 35–37, (1990).

* cited by examiner

*Primary Examiner*—Weilun Lo
(74) *Attorney, Agent, or Firm*—John VanOphem

(57) ABSTRACT

An actuator includes a cylinder having a central axis and a side wall. The side wall has an inner surface. A clutch is disposed within the cylinder, and includes a hub and at least one clutch arm. Each clutch arm includes a negative opposing finger, a positive opposing finger, a negative opposing spring and a positive opposing spring. The negative opposing finger has a first end attached to the hub and a fingertip end engaging the inner surface of the side wall. The positive opposing finger has a first end attached to the hub and a fingertip end engaging the inner surface of the side wall. The negative opposing spring has a first end attached to the negative opposing finger. The positive opposing spring has a first end attached to the positive opposing finger. A control input is configured for engaging a second end of a selected one of the negative opposing spring and the positive opposing spring. By selectively reducing one set of opposing spring forces and increasing the other set of spring forces, an oscillating torque imposed on the hub can be converted to controlled hub rotational displacement.

20 Claims, 4 Drawing Sheets

ACTUATOR FOR VARIABLE VALVE MECHANISM

CROSS-REFERENCE TO RELATED APPLICATIONS

This application claims the benefit of U.S. Provisional Patent Application Serial No. 60/176,131, filed Jan. 14, 2000.

TECHNICAL FIELD

The present invention relates to actuators for use with variable valve mechanisms of internal combustion engines.

BACKGROUND OF THE INVENTION

A variable valve mechanism controls the valve lift profile (i.e., the amount and duration of lift) of one or more associated valves of an engine in response to engine operating parameters, such as, for example, engine load, speed, and driver input. Generally, the valve lift profile is set by an actuator which, varies the angular position of a control shaft which, in turn, varies the angular position of the variable valve mechanism relative to a central axis of an input shaft or camshaft of the engine to which the variable valve mechanism is pivotally mounted.

Actuators for variable valve mechanisms typically include a motor and gearbox. One example of an actuator for a variable valve mechanism is described in commonly-assigned U.S. Pat. No. 6,019,076, the disclosure of which is incorporated herein by reference. The gearbox includes a worm which engages a worm gear disposed on or connected to the control shaft. When a change in the valve lift profile is desired, the motor rotates the worm which, in turn, rotates the worm gear. Rotation of the worm gear pivots the control shaft relative to its central axis which, in turn, angularly positions the variable valve mechanism relative to the central axis of the camshaft to thereby establish a desired valve lift profile.

The input or camshaft of the engine is driven by the engine and rotates three-hundred sixty degrees. As stated herein, the variable valve mechanism is pivotally mounted on an input shaft or camshaft of the engine. The variable valve mechanism is subjected to torque as a result of the rotation of the camshaft or input shaft to which it is pivotally mounted. This torque is reflected from the variable valve mechanism through the control shaft and back to the actuator. A spring acts upon the worm gear and/or the control shaft to substantially equalize the positive and negative peaks of the reflected torque to which the control shaft and actuator are subjected. In the static state, i.e., when the control shaft is stationary, the pressure and lead angles of the teeth of the worm and worm gear are designed such that torque reflected from the variable valve mechanism through the control shaft causes the worm and the worm gear to lock up. The locking of the worm and worm gear in the static state prevent the reflected torque from being transmitted to the motor. However, in order to pivot the control shaft, the motor must be adequately powered to unlock the worm and worm gear and to overcome the reflected torque.

During pivoting of the control shaft, the worm and worm gear are no longer locked up. Thus, the motor is subjected to the reflected torque peaks. The reflected torque peaks may reach a large enough magnitude and, if directed opposite to the direction of motor rotation, cause the worm and worm gear to lock up and the motor to stall. The motor will remain stalled until the momentary torques decrease and the motor is again able to drive the mechanism in the desired direction.

Such conventional actuators require numerous parts, complicated control means, and lash adjustment systems to compensate for tolerances in manufacturing, temperature changes, and wear. The motor and gearbox must be relatively large and powerful in order to overcome the reflected torque peaks, and thus consume a substantial amount of space. An overpowered motor is relatively expensive and heavy.

Therefore, what is needed in the art is an actuator for variable valve mechanisms that has fewer parts and is less costly to manufacture.

Furthermore, what is needed in the art is an actuator for variable valve mechanisms that requires no lash adjustment system.

Still further, what is needed in the art is an actuator for variable valve mechanisms that is less sensitive to and less affected by reflected torque.

SUMMARY OF THE INVENTION

The present invention provides an actuator for use with variable valve mechanisms of internal combustion engines.

The invention comprises, in one form thereof, a cylinder having a central axis and a side wall. The side wall has an inner surface. A clutch is disposed within the cylinder, and includes a hub and at least one clutch arm. Each clutch arm includes a negative opposing finger, a positive opposing finger, a negative opposing spring and a positive opposing spring. The negative opposing finger has a first end attached to the hub and a fingertip end engaging the inner surface of the side wall. The positive opposing finger has a first end attached to the hub and a fingertip end engaging the inner surface of the side wall. The negative opposing spring has a first end attached to the negative opposing finger. The positive opposing spring has a first end attached to the positive opposing finger. A control input is disposed within said cylinder, and is configured for engaging a second end of a selected one of the negative opposing spring and the positive opposing spring.

An advantage of the present invention is that a simpler and less expensive gear box can be used since torque peaks from the control shaft are substantially absorbed by the clutch.

Another advantage of the present invention is that it requires no lash adjustment system.

A still further advantage of the present invention is that it consumes less space and is lighter in weight than conventional actuators.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in many manner.

DESCRIPTION OF THE PREFERRED EMBODIMENTS

Figure 1:
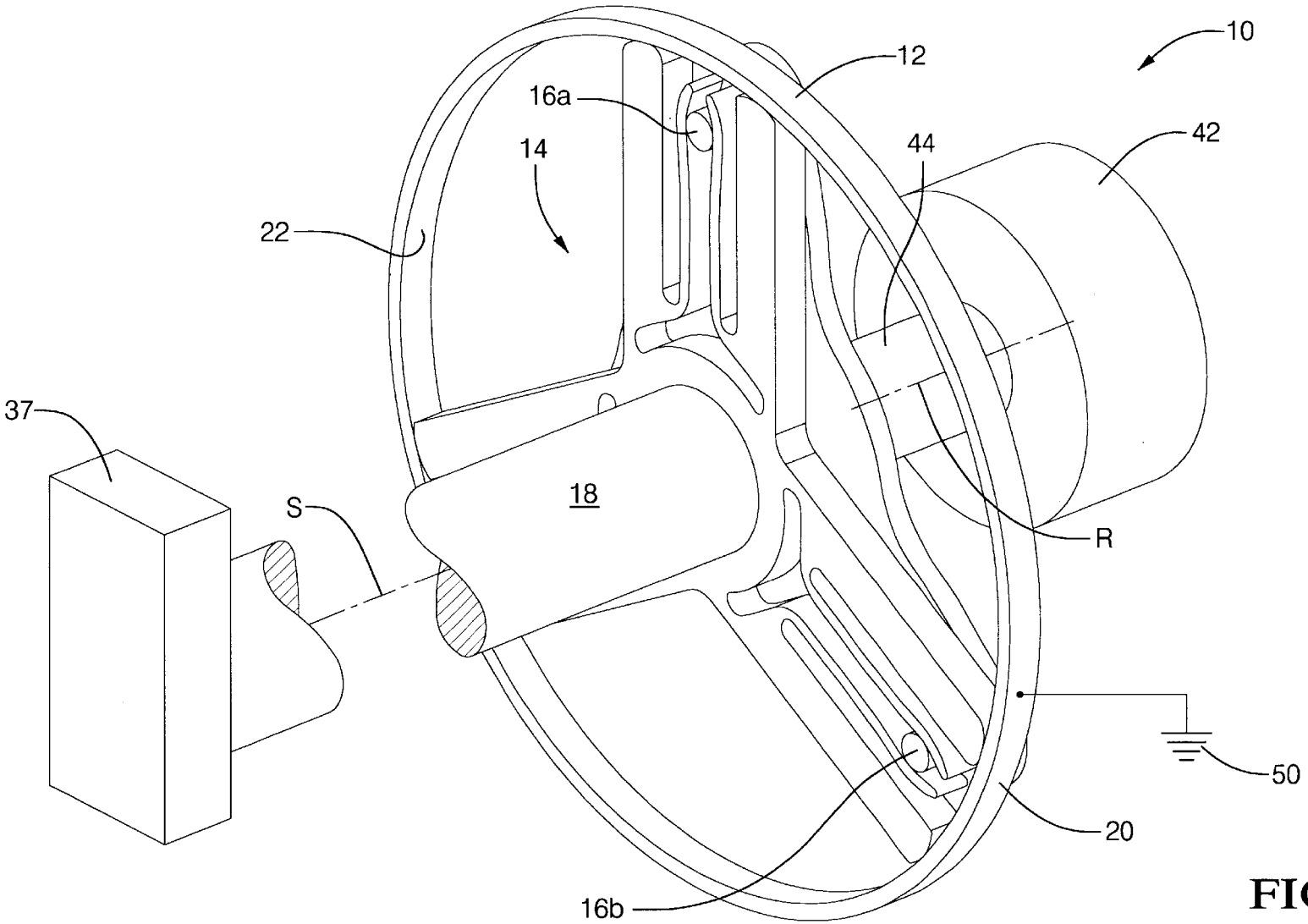
FIG. 1 is an isometric view of one embodiment of an actuator of the present invention.
Figure 2:
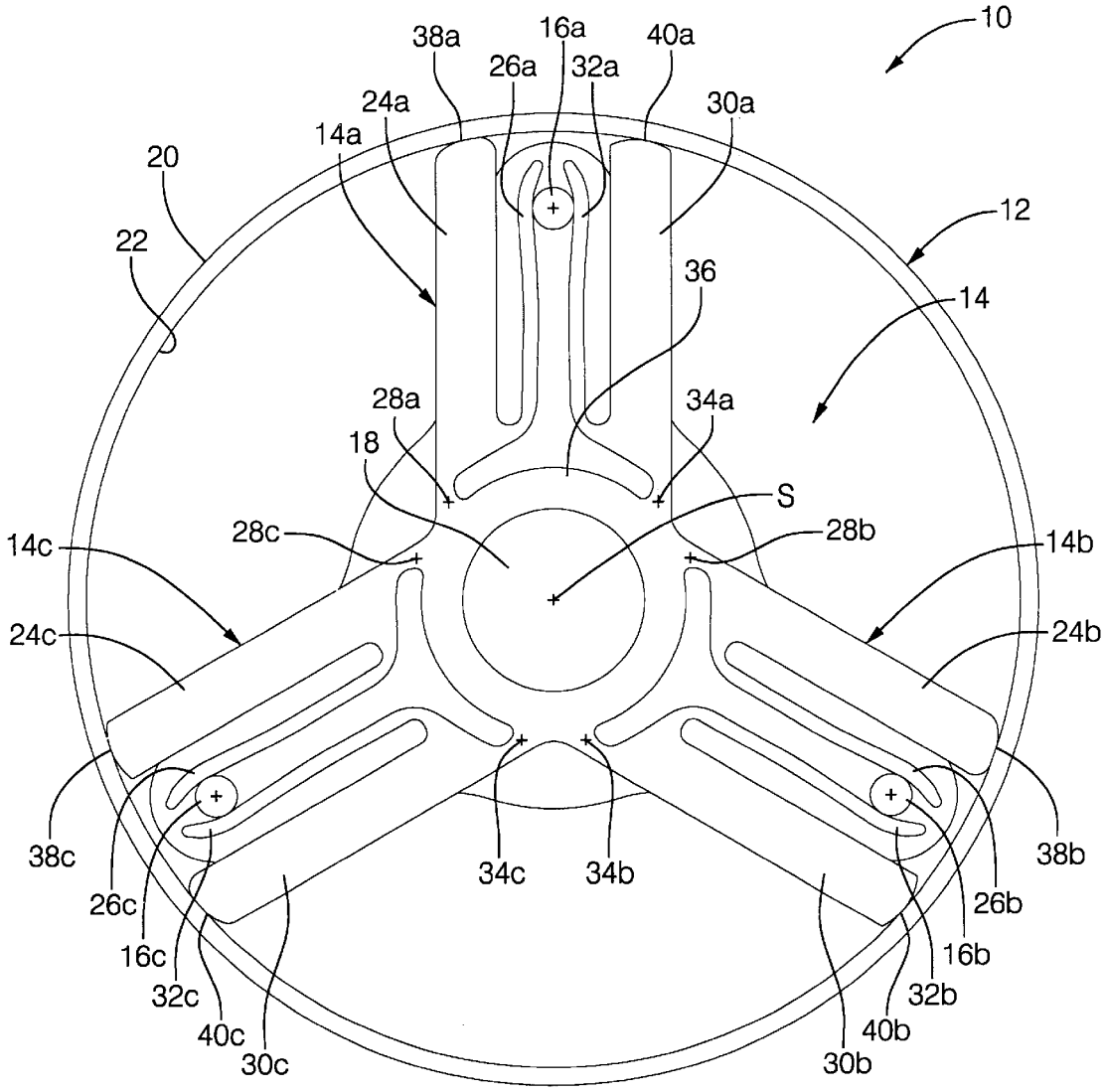
FIG. 2 is a front view of the actuator of FIG. 1.

Referring now to the drawings, and particularly to FIGS. 1 and 2, there is shown one embodiment of an actuator of the present invention. Actuator 10 includes cylinder 12, clutch 14, actuator inputs 16*a,* 16*b* and 16*c,* and elongate control shaft 18.

As will be discussed more particularly hereinafter, actuator 10, dependent at least in part upon input from an engine control module (not shown), selectively varies the angular position of control shaft 18 relative to a central axis S thereof. Actuator 10 rotates control shaft 18 by utilizing reflected torque rather than a motor/gearbox, and is substantially less sensitive to reflected torque than a conventional actuator.

Cylinder 12 is a short cylinder having central axis S. Cylinder 12 is attached, such as, for example, by bolts or other suitable fastening means, to an engine block 50 or other stationary object. Cylinder 12 includes sidewall 20 having inner surface 22. A portion (not referenced) of control shaft 18 is disposed within cylinder 12 and a second portion (not referenced) of control shaft 18 is disposed external to cylinder 12.

Clutch 14 includes three clutch arms 14*a*, 14*b* and 14*c*. Clutch arms 14*a*, 14*b*, 14*c* include negative opposing fingers 24*a*, 24*b* and 24*c*, negative opposing springs 26*a*, 26*b* and 26*c*, negative opposing hinges 28*a*, 28*b* and 28*c*, positive opposing fingers 30*a*, 30*b* and 30*c*, positive opposing springs 32*a*, 32*b* and 32*c*, positive opposing hinges 34*a*, 34*b* and 34*c*, respectively. Clutch arm 14*a* includes opposing finger 24*a*, negative opposing spring 26*a*, negative opposing hinge 28*a*, positive opposing finger 30*a*, positive opposing spring 32*a*, and positive opposing hinge 34*a*. Similarly, clutch arms 14*a* and 14*b* include negative opposing fingers 24*b*, 24*c*, negative opposing springs 26*b*, 26*c*, negative opposing hinges. 28*b*, 28*c*, positive opposing fingers 30*b*, 30*c*, positive opposing springs 32*b*, 32*c*, and positive opposing hinges 34*b*, 34*c*, respectively. Each of clutch arms 14*a*, 14*b* and 14*c* are interconnected, such as, for example affixed to or integral with, hub 36. Thus, clutch 14 includes three substantially identical clutch arms 14*a*, 14*b*, 14*c*. In the interest of clarity, only clutch arm 14*a* is described in detail hereinafter since the construction and principle of operation of clutch arm 14*a* is substantially identical to the construction and principle of operation of clutch arms 14*b* and 14*c*.

Negative opposing finger 24*a* is at a first end (not referenced) affixed to or integral with negative opposing hinge 28*a*. Negative opposing finger 24*a* engages inner surface 22 of sidewall 20 at negative opposing fingertip 38*a*. Similarly, positive opposing finger 30*a* is at a first end (not referenced) affixed to or integral with positive opposing hinge 34*a*. Positive opposing finger 30*a* engages inner surface 22 of sidewall 20 at positive opposing fingertip 40*a*.

Negative opposing spring 26*a* is configured, such as, for example, a compression spring or cantilever spring. Negative opposing spring 26*a* is at one end (not referenced) attached to or integral with negative opposing finger 24*a* and engages at the other end (not referenced) actuator input 16*a*. Similarly, positive opposing spring 32*a* is configured, such as, for example, a cantilever spring. Positive opposing spring is at one end (not referenced) attached to or integral with positive opposing finger. 30*a* and engages at the other end (not referenced) actuator input 16*a*.

Negative opposing hinge 28*a* and positive opposing hinge 34*a* interconnect hub 36 to negative opposing finger 24*a* and to positive opposing finger 30*a*, respectively. Negative opposing hinge 28*a* and positive opposing hinge 34*a* are configured, such as, for example, flexible regions that are integral and monolithic with negative opposing finger 24*a* and positive opposing finger 30*a*, respectively.

Figure 3:
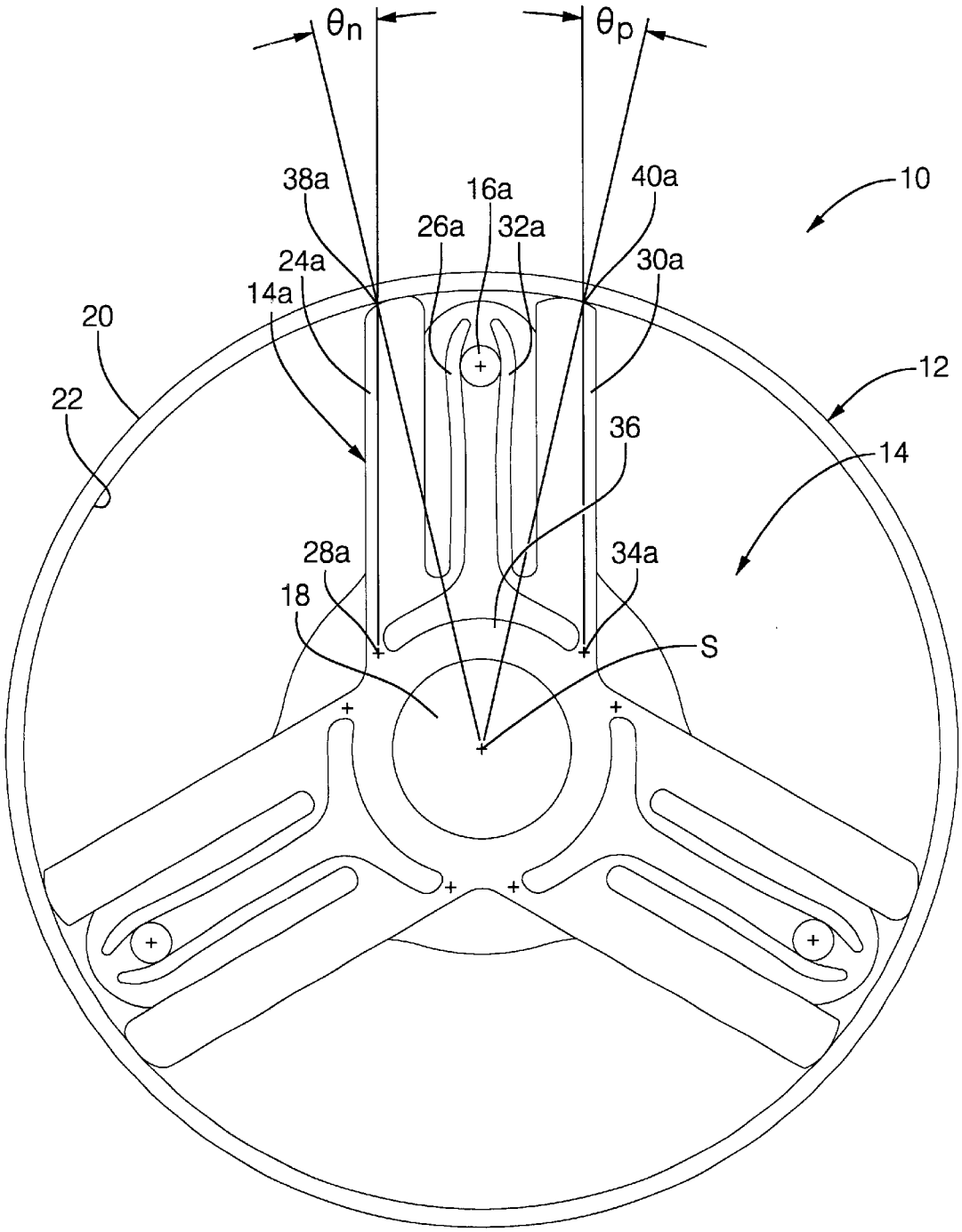
FIG. 3 is a second front view of the actuator of FIG. 1.

Negative opposing finger 24*a* engages inner surface 22 of sidewall 20 at angle (FIG. 3). Angle $\theta_n$ is defined between a first line, drawn from negative opposing hinge 28*a* through the point that negative opposing fingertip 38*a* is in contact with inner surface 22 of sidewall 20, and a second line drawn from central axis S through the point that negative opposing fingertip 38*a* is in contact with inner surface 22 of sidewall 20. Angle $\theta_n$ determines, in part, the magnitude of the frictional force between negative opposing fingertip 38*a* and inner surface 22.

Similarly, positive opposing finger 30*a* engages inner surface 22 of sidewall 20 at angle $\theta_p$. More particularly, angle $\theta_p$ is formed between a first line drawn from positive opposing hinge 34*a* through the point that positive opposing fingertip 40*a* is in contact with inner surface 22 of sidewall 20 and a second line drawn from central axis S through the point that positive opposing fingertip 40*a* is in contact with inner surface 22 of sidewall 20. Angle $\theta_p$ determines,, in part, the magnitude of the frictional force between positive opposing fingertip 40*a* and inner surface 22.

Hub 36 is coupled, such as, for example, affixed to or integral with control shaft 18. Control shaft 18 and clutch 14 pivot or rotate as substantially one body.

Actuator input 16*a* engages negative opposing spring 26*a* and positive opposing spring 32*a*. Each actuator input 16*a*, 16*b*, 16*c* is connected to motor 42 by motor shaft 44 having control axis R (FIG. 1). Motor 42 is, for example, an electric motor, and is operable to pivot each actuator input 16*a*, 16*b*, 16*c* relative to central axis S. Control shaft axis S is shown coaxial with motor axis R, but need not be.

Control shaft 18 is an elongate shaft. A first portion (not referenced) of control shaft 18 is disposed within cylinder 12 and is substantially concentric therewith. A second portion (not referenced) of control shaft 18 is disposed external to cylinder 12. One or more variable valve mechanisms 37 are pivotally coupled to the second portion of control shaft 18. Control shaft 18 is interconnected, such as, for example, affixed to or integral with hub 36.

Figure 4:
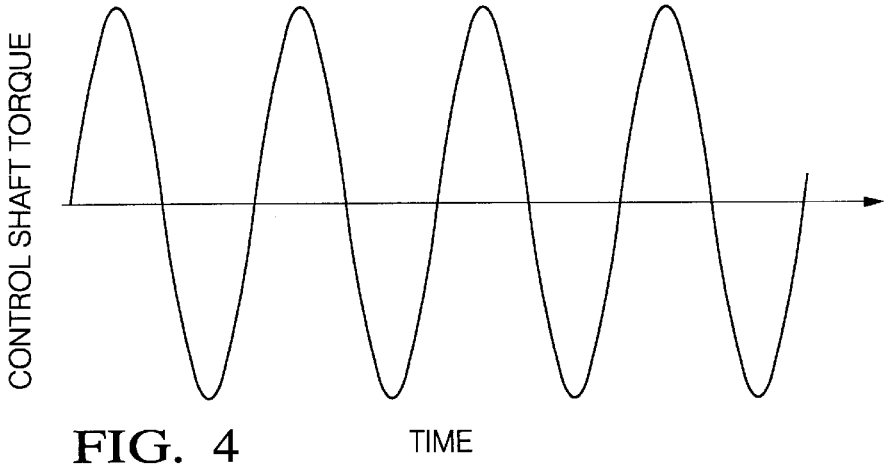
FIG. 4 is a graph of the reflected torque to which the control shaft of the actuator of FIG. 1 is subjected plotted against time.

In use, control shaft 18 is pivotally coupled to one or more variable valve mechanisms of engine 50 (FIG. 1). Control shaft 18 is subjected to reflected torque due to the opening and closing of the one or more variable valve mechanisms pivotally coupled thereto. This torque is reflected back through control shaft 18 to actuator 10. A sine-wave representation of the reflected torque is plotted versus time in FIG. 4, however it is to be understood that the reflected torque can have virtually any periodic or non-periodic shape and/or function with different peak magnitudes of positive/counter-clockwise and negative/clockwise reflected torque. Referring to FIG. 4, a positive/counter-clockwise torque is followed by a negative/clockwise torque, which is, in turn, followed by a positive torque, etc.

In the static state, actuator input 16*a* is held at a point substantially equidistant from negative opposing finger 24*a* and positive opposing finger 30*a* by motor 42. The frictional force between inner surface 22 of sidewall 20 and the negative opposing fingertip 38*a* depends on the angle $\theta_n$, the coefficient of friction between negative opposing fingertip 38*a* and inner surface 22 of sidewall 20, and the spring force applied by negative opposing spring 26*a* to negative opposing finger 24*a*. Likewise, the frictional force between inner surface 22 of sidewall 20 and the positive opposing fingertip 40*a* depends on the angle $\theta_p$, the coefficient of friction between positive opposing fingertip 40*a* and inner surface 22 of sidewall 20, and the spring force applied by positive opposing spring 32*a* to positive opposing finger 30*a*.

The angles $\theta_n$ and $\theta_p$ are determined, at least in part, by the geometry of negative opposing finger 24*a* and positive opposing finger 30*a*, respectively. The coefficients of friction are determined by material properties, such as, for example, the surface roughness of the material from which negative opposing fingertip 38*a*, positive opposing fingertip 40*a*, and inner surface 22 of sidewall 20 are constructed. The spring forces are determined by selecting the spring constant of the material from which negative opposing and positive opposing springs 26*a*, 32*a*, respectively, are constructed and by the amount of compression applied to negative opposing and positive opposing springs 26*a*, 32*a*, respectively, by actuator input 16.

A negative/clockwise reflected torque on control shaft 18 is transmitted to inner surface 22 through negative opposing fingers 24*a*, 24*b*, 24*c*. In the static state, the frictional force between negative opposing fingertips 38*a*, 38*b*, 38*c* and inner surface 22 is sufficient to resist the negative/clockwise reflected torque and preclude clutch 14 from pivoting relative to central axis S in the negative torque direction. Since control shaft 18 is affixed to and/or integral with clutch 14, control shaft 18 is substantially precluded from pivotal movement in the negative/clockwise direction relative to central axis S. Thus, the valve lift profile of the one or more variable valve mechanisms as established by the rotational position of control shaft 18 remains unchanged, and motor 42 is substantially isolated from the negative/clockwise reflected torque imposed upon control shaft 18.

Similarly, a positive/counter-clockwise reflected torque on control shaft 18 is transmitted to inner surface 22 through positive opposing fingers 30*a*, 30*b*, 30*c*. In the static state, the frictional force between positive opposing fingertips 40*a*, 40*b*, 40*c* and inner surface 22 is sufficient to resist the positive/counter-clockwise reflected torque and preclude clutch. 14 from pivoting relative to central axis S in the positive torque direction. Since control shaft 18 is affixed to and/or integral with clutch 14, control shaft 18 is substantially precluded from pivotal movement in the positive/counter-clockwise direction relative to central axis S. Thus, the valve lift profile of the variable valve mechanisms as established by the rotational position of control shaft 18 remains unchanged, and motor 42 is substantially isolated from the positive/counter-clockwise reflected torque imposed upon control shaft 18.

Generally, actuator 10 utilizes the reflected torque to pivot control shaft 18 relative to central axis S in response to an appropriate position input signal from an engine control module (ECM) (not shown). More particularly, in response to an appropriate position input signal from an ECM (not shown) corresponding to, for example, a request for positive/counter-clockwise pivotal movement of control shaft 18 to a desired position, motor 42 pivots actuator inputs 16*a*, 16*b*, 16*c* relative to central axis S in the positive direction thereby decreasing the compression of positive opposing springs 32*a*, 32*b*, 32*c* and increasing the compression of negative opposing springs 26*a*, 26*b*, 26*c*. The decrease in compression of positive opposing springs 32*a*, 32*b*, 32*c*, in turn, decreases the spring force applied to positive opposing fingers 30*a*, 30*b*, 30*c* thereby decreasing the frictional forces between positive opposing fingertips 40*a*, 40*b*, 40*c* and inner surface 22. The increase in compression of negative opposing springs 26*a*, 26*b*, 26*c*, in turn, increases the spring force applied by negative opposing springs 26*a*, 26*b*, 26*c* to negative opposing fingers 24*a*, 24*b*, 24*c* thereby increasing the frictional forces between negative opposing fingertips 38*a*, 38*b*, 38*c* and inner surface 22. Thus, the frictional forces between positive opposing fingertips 40*a*, 40*c*, 40*c* and 20 inner surface 22 is decreased while the frictional forces between negative opposing fingertips 38*a*, 38*b*, 38*c* and inner surface 22 is increased. Therefore, the frictional forces opposing a positive/counter-clockwise torque on control shaft 18 are decreased and the forces opposing a negative/clockwise torque on control shaft 18 are increased. When the reflected positive/counter-clockwise torque acting upon control shaft 18 reaches a predetermined magnitude that is sufficient to overcome the reduced positive/counter-clockwise opposing frictional force between inner surface 22 and positive opposing fingertips 40*a*, 40*b*, 40*c*, control shaft 18 and clutch 14 pivot in the positive/counter-clockwise direction. Thus, actuator 10, utilizes the reflected torque to pivot control shaft 18 in a clockwise direction relative to central axis S.

The predetermined magnitude at which the positive/counter-clockwise reflected torque overcomes the reduced positive/counter-clockwise opposing frictional forces is selected by establishing a specific angle for angle $\theta_p$, the coefficient of friction between positive opposing fingertips 40*a*, 40*b*, 40*c* and inner surface 22, and the spring force applied by positive opposing springs 32*a*, 32*b*, 32*c* to positive opposing fingers 30*a*, 30*b*, 30*c*. By adjusting these parameters, the reduced positive/counter-clockwise opposing frictional force between inner surface 22 and positive opposing fingertips 40*a*, 40*b*, 40*c* is selected to have a magnitude which is less than a predetermined level or percentage of the peak magnitude of reflected torque that is anticipated in a particular application.

The magnitude of the positive/counter-clockwise reflected torque required to overcome the reduced positive/counter-clockwise opposing force is modified during operation of actuator 10 by changing the amount by which actuator inputs 16*a*, 16*b*, 16*c* are pivoted away from positive opposing fingers 30*a*, 30*b*, 30*c*. As the distance from which actuator inputs 16*a*, 16*b*, 16*c* are pivoted away from positive opposing fingers 30*a*, 30*b*, 30*c* increases, the spring force applied by positive opposing springs 32*a*, 32*b*, 32*c* to positive opposing fingers 30*a*, 30*b*, 30*c* decreases. Thus, the frictional forces between positive opposing fingertips 40*a*, 40*b*, 40*c* and inner surface 22 decrease and control shaft 18 is pivoted in the positive/counter-clockwise direction by a smaller positive/counter-clockwise reflected torque. Conversely, a smaller distance of pivot of actuator inputs 16*a*, 16*b*, 16*c* away from positive opposing fingers 30*a*, 30*b*, 30*c* results in a larger spring force applied by positive opposing springs 32*a*, 32*b*, 32*c* to positive opposing fingers 30*a*, 30*b*, 30*c*. Thus, the frictional forces between positive opposing fingertips 40*a*, 40*b*, 40*c* and inner surface 22 are relatively large and the pivoting of control shaft 18 in a positive/counter-clockwise direction requires a larger positive/counter-clockwise reflected torque.

In the event that the positive/counter-clockwise reflected torque acting upon control shaft 18, and thus clutch 14, decreases below or becomes negative relative to the positive/counter-clockwise opposing frictional force prior to control shaft 18 completing its positive/counter-clockwise pivoting to the desired position, the pivoting of clutch 14 and control shaft 18 in a negative/clockwise direction is substantially precluded by negative opposing fingers 24*a*, 24*b*, 24*c*. More particularly, as the reflected torque on control shaft 18 and thus clutch 14 decreases toward zero and/or becomes negative/clockwise the negative/clockwise opposing frictional force between negative opposing fingertips 38*a*, 38*b*, 38*c* and inner surface 22 is sufficient to oppose the negative/clockwise reflected torque. As stated above, in response to a command corresponding to a request for positive/counter-clockwise pivotal movement of control shaft 18, motor 42 pivots actuator inputs 16*a*, 16*b*, 16*c* about central axis S in the positive direction thereby decreasing the compression of positive opposing springs 32*a*, 32*b*, 32*c* and increasing the compression of negative opposing springs 26*a*, 26*b*, 26*c*. The increase in compression of negative opposing springs 26*a*, 26*b*, 26*c*, in turn, increases the spring force applied by negative opposing springs 26*a*, 26*b*, 26*c* to negative opposing fingers 24*a*, 24*b*, 24*c* thereby increasing the frictional forces between negative opposing fingertips 38*a*, 38*b*, 38*c* and inner surface 22. Thus, the frictional force between negative opposing fingertips 38*a*, 38*b*, 38*c* and inner surface 22 is increased. Therefore, the frictional force opposing a negative/clockwise torque on control shaft 18 is increased thereby substantially precluding pivotal movement of control shaft 18 in a negative/clockwise direction when the positive/counter-clockwise reflected torque decreases and/or becomes negative. Control shaft 18 is again caused to pivot in a positive/counter-clockwise direction relative to central axis S when the reflected torque returns to and/or exceeds the predetermined magnitude in the appropriate polarity/direction, and so long as actuator inputs 16*a*, 16*b*, 16*c* remain in a position consistent with pivotal movement of control shaft 18 in that direction.

The operation of actuator 10 for negative/clockwise pivoting of control shaft 18 is substantially similar to the operation thereof during positive/counter-clockwise pivotal movement of control shaft 18, as described above. More particularly, in response to an appropriate signal requesting negative/clockwise pivoting of control shaft 18 to a desired position, motor 42 pivots actuator inputs 16*a*, 16*b*, 16*c* relative to central axis S in the negative direction thereby increasing the compression of positive opposing springs 32*a*, 32*b*, 32*c* and decreasing the compression of negative opposing springs 26*a*, 26*b*, 26*c*. The increase in compression of positive opposing springs 32*a*, 32*b*, 32*c*, in turn, increases the spring force applied by positive opposing springs 32*a*, 32*b*, 32*c* to positive opposing fingers 30*a*, 30*b*, 30*c* thereby increasing the frictional forces between positive opposing fingertips 40*a*, 40*b*, 40*c* and inner surface 22. The decrease in compression of negative opposing springs 26*a*, 26*b*, 26*c*, in turn, decreases the spring force applied by negative opposing springs 26*a*, 26*b*, 26*c* to negative opposing fingers 24*a*, 24*b*, 24*c* thereby decreasing the frictional forces between negative opposing fingertips 38*a*, 38*b*, 38*c* and inner surface 22. Thus, the frictional force between positive opposing fingertips 40*a*, 40*c*, 40*c* and inner surface 22 is increased while the frictional force between negative opposing fingertips 38*a*, 38*b*, 38*c* and inner surface 22 is decreased. Therefore, the frictional force opposing a positive/counter-clockwise torque on control shaft 18 is increased and the force opposing a negative/clockwise torque on control shaft 18 is decreased. When the reflected positive/counter-clockwise torque acting upon control shaft 18 reaches a predetermined magnitude that is sufficient to overcome the reduced negative/clockwise opposing frictional force between inner surface 22 and negative opposing fingertips 38*a*, 38*b*, 38*c*, control shaft 18 and clutch 14 pivot in the negative/clockwise direction. Thus, actuator 10, utilizes the reflected torque to pivot control shaft 18 in a negative/clockwise direction about central axis S.

The predetermined magnitude at which the negative/clockwise reflected torque overcomes the reduced negative/clockwise opposing frictional force is selected by establishing a specific angle for angle $\theta_n$, the coefficient of friction between negative opposing fingertips 38*a*, 38*b*, 38*c* and inner surface 22, and the spring force due to negative opposing springs 26*a*, 26*b*, 26*c*, as described above. By adjusting these parameters, the reduced negative/clockwise opposing frictional forces between inner surface 22 and negative opposing fingertips 38*a*, 38*b*, 38*c* is selected to have a magnitude which is less than a predetermined level or percentage of the peak magnitude of reflected torque that is anticipated in a particular application.

The magnitude of the negative/clockwise reflected torque required to overcome the reduced negative/clockwise opposing forces is modified during operation of actuator 10 by changing the amount by which actuator inputs 16*a*, 16*b*, 16*c* are pivoted away from negative opposing fingers 24*a*, 24*b*, 24*c*. As the distance from which actuator inputs 16*a*, 16*b*, 16*c* are pivoted away from negative opposing fingers 24*a*, 24*b*, 24*c* increases, the spring force applied by negative opposing springs 26*a*, 26*b*, 26*c* to negative opposing fingers 24*a*, 24*b*, 24*c* decreases. Thus, the frictional forces between negative opposing fingertips 38*a*, 38*b*, 38*c* and inner surface 22 decrease and control shaft 18 is pivoted in the negative/clockwise direction by a smaller negative/clockwise reflected torque. Conversely, a smaller distance of pivot of actuator inputs 16*a*, 16*b*, 16*c* away from negative opposing fingers 24*a*, 24*b*, 24*c* results in a larger spring force applied by negative opposing springs 26*a*, 26*b*, 26*c* to negative opposing fingers 24*a*, 24*b*, 24*c*. Thus, the frictional forces between negative opposing fingertips 38*a*, 38*b*, 38*c* and inner surface 22 are relatively large and the pivoting of control shaft 18 in the negative/clockwise direction requires a larger negative/clockwise reflected torque.

In the event that the negative/clockwise reflected torque acting upon control shaft 18, and thus clutch 14, decreases in magnitude or becomes opposite in direction relative to the negative/clockwise opposing frictional force prior to control shaft 18 completing its negative/clockwise pivoting to the desired position, the pivoting of clutch 14 and control shaft 18 in a positive/counter-clockwise direction is substantially precluded by positive opposing fingers 30*a*, 30*b*, 30*c*. Positive opposing fingers 30*a*, 30*b*, 30*c* substantially preclude positive/counter-clockwise pivoting of control shaft 18 as a result of a reversal in the direction of reflected torque in a substantially identical manner as described above in regard to the opposition of negative/clockwise pivoting of control shaft 18 by negative opposing fingers 24*a*, 24*b*, 24*c* as a result of a decrease or reversal in direction of a positive/counter-clockwise reflected torque.

Figure 5:
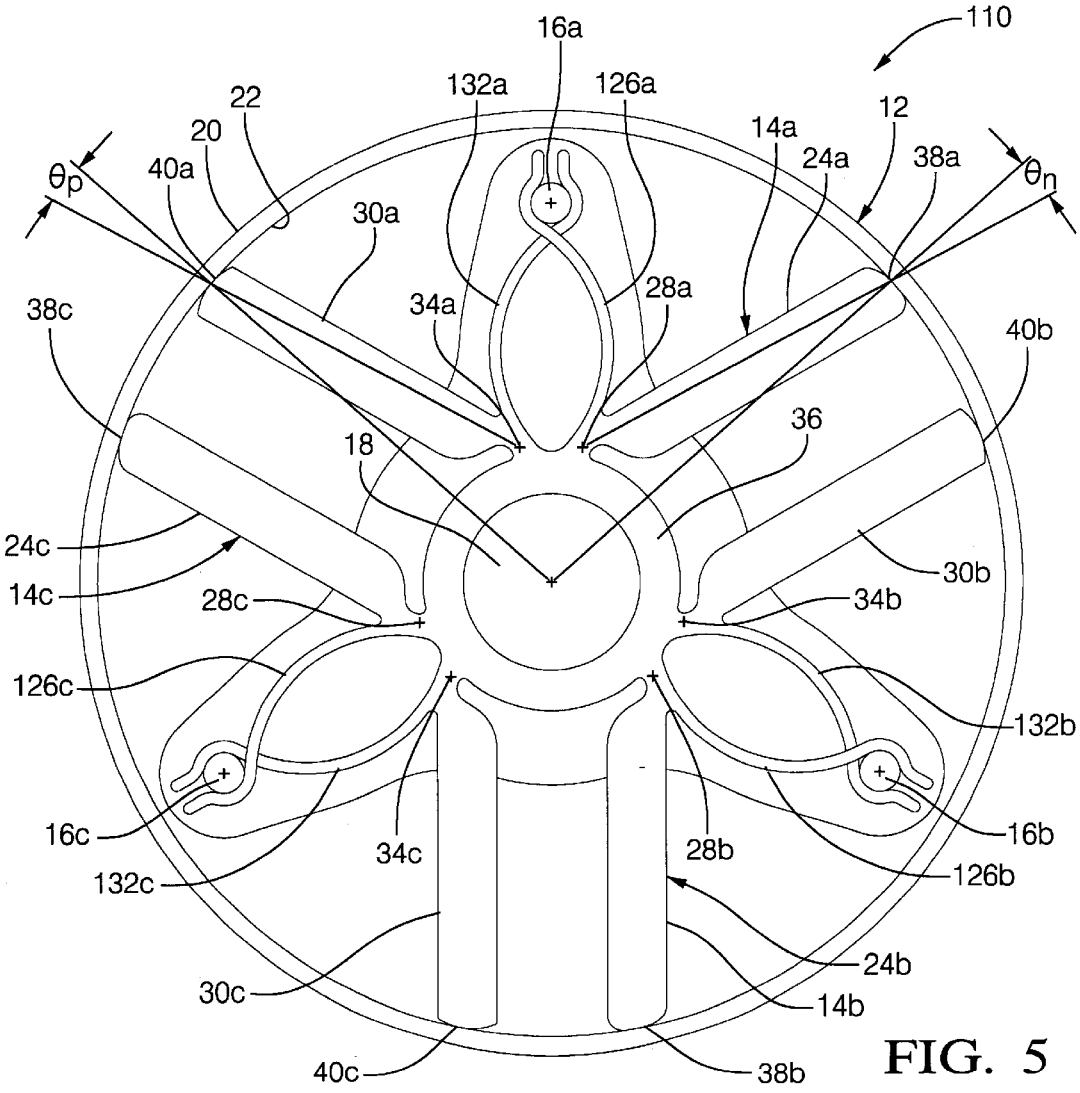
FIG. 5 is a front view of a second embodiment of an actuator of the present invention.

Referring now to FIG. 5, a second embodiment of an actuator of the present invention is shown. The same reference numbers are used indicate component parts of actuator 110 that are substantially identical in structure and function as those of actuator 10, described above. Actuator 110 includes negative opposing fingers 24*a*, 24*b*, 24*c*, negative opposing hinges 28*a*, 28*b*, 28*c*, positive opposing fingers 30*a*, 30*b*, 30*c*, positive opposing hinges 34*a*, 34*b*, 34*c*, and hub 36. In contrast to actuator 10, actuator 110 includes negative opposing springs 126*a*, 126*b*, 126*c* and positive opposing springs 132*a*, 132*b*, 132*c*, which are configured as cantilever springs.

In use, actuator 110 utilizes reflected torque to pivot control shaft 18 relative to central axis S in a substantially similar manner as described above in regard to actuator 10. More particularly, in order to pivot control shaft 18 in a positive/counter-clockwise direction, actuator inputs 16*a*, 16*b*, 16*c* are pivoted in a positive/counter-clockwise direction relative to central axis S thereby decreasing the spring force applied by positive opposing springs 132*a*, 132*b*, 132*c* to positive opposing fingers 30*a*, 30*b*, 30*c* and increasing the spring force applied by negative opposing springs 126*a*, 126*b*, 126*c* to negative opposing fingers 24*a*, 24*b*, 24*c*. The decrease in the spring force applied by positive opposing springs 132*a*, 132*b*, 132*c* to positive opposing fingers 30*a*, 30*b*, 30*c*, in turn, decreasing the frictional forces between positive opposing fingertips 40*a*, 40*b*, 40*c* and inner surface 22. The increase in spring force applied by negative opposing springs 126*a*, 126*b*, 126*c* to negative opposing fingers 24*a*, 24*b*, 24*c*, in turn, increases the frictional forces between negative opposing fingers 24*a*, 24*b*, 24*c* and inner surface 22. Thus, the frictional force between positive opposing fingertips 40*a*, 40*c*, 40*c* and inner surface 22 is decreased while the frictional force between negative opposing fingertips 38*a*, 38*b*, 38*c* and inner surface 22 is increased. Therefore, the frictional force opposing a positive/counter-clockwise torque on control shaft 18 is decreased and the force opposing a negative/clockwise torque on control shaft 18 is increased. When the reflected positive/counter-clockwise torque acting upon control shaft 18 reaches a predetermined magnitude that is sufficient to overcome the reduced positive/counter-clockwise opposing frictional force between inner surface 22 and positive opposing fingertips 40*a*, 40*b*, 40*c*, control shaft 18 and clutch 14 pivot in the positive/counter-clockwise direction. Thus, actuator 110, utilizes the reflected torque to pivot control shaft 18 in a clockwise direction relative to central axis S in a substantially similar manner to actuator 10. Furthermore, actuator 110 resists and substantially precludes pivoting of control shaft 18 in the event of a decrease or reversal of reflected torque in a substantially similar manner as that described above in regard to actuator 10.

It should be particularly noted that the actuator of the present invention has substantially no wind-up or backlash and therefore has a substantially improved resolution for the pivoting of control shaft 18 relative to conventional actuators and/or clutches.

It should further be particularly noted that the torque capacity of actuators 10 and 110 can be increased by increasing the thickness of clutch 14 and the length of cylinder 12.

In the embodiments shown, the actuator of the present invention can be configured to preferentially pivot control shaft 18 relative to central axis S in a predetermined direction by selecting the frictional force which opposes pivoting thereof in the preferred direction to be less than the frictional force which opposes pivoting in the direction opposite to the preferred direction. Thus, the frictional force opposing pivoting in the preferred direction is overcome by a lower magnitude of reflected torque than is the frictional force which opposes pivoting in the direction that is opposite to the preferred direction. Similarly, pivoting of control shaft 18 in a predetermined direction is favored by selecting the frictional force that opposes pivoting of control shaft 18 in the direction opposite to the predetermined direction to have a larger value than the value of the frictional force which opposes pivoting thereof in the predetermined direction. For example, in order to preferentially pivot control shaft 18 in a negative/clockwise direction, the parameters described above that govern the frictional force between negative opposing fingertips 38*a*, 38*b*, 38*c* and inner surface 22 are selected such that the frictional force there between is less than the frictional force between positive opposing fingertips 40*a*, 40*b*, 40*c* and inner surface 22. Therefore, the negative/clockwise opposing frictional force is. overcome by a smaller magnitude of reflected torque. Thus, control shaft 18 is pivoted in a negative/clockwise direction at a lower magnitude of reflected torque than is required to pivot control shaft 18 in a positive/counter-clockwise direction.

In the embodiments shown, the actuator of the present invention does not include a gearbox. Furthermore, the force applied by motor 42 does not directly pivot control shaft 18. However, it is to be understood that the actuator of the present invention can be alternately configured with a gearbox and a second motor associated. In this embodiment, an ECM commands the second motor to apply a torque to control shaft 18 and appropriately activates the actuator of the present invention to enable pivoting of control shaft 18. Because the actuator of the present invention has substantially reduced sensitivity to reflected torque, the motor and gearbox optionally associated with the actuator of the present invention can be configured with substantially smaller torque/power capabilities, and can therefore be of a smaller size and lighter weight, relative to those associated with a conventional actuator. Such an optional embodiment will be particularly useful for conditions when the engine oil viscosity is high, such as, for example, at engine start or cold operation, and when torque on control shaft 18 is low, such as, for example, when the variable valve mechanism places the valves in a low lift profile.

In the embodiments shown, the reflected torque to which control shaft 18 is subjected is depicted (FIG. 3) as a sine wave having peaks of equal magnitude. However, it is to be understood that the present invention can utilize reflected torque having virtually any periodic waveform shape and/or function, and having different and/or varying peak magnitudes of positive and negative torque.

In the embodiments shown, actuator 10 is disclosed as being for use with variable valve mechanisms (not shown). However, it is to be understood that actuator 10 can be alternately configured, such as, for example, for use with various other mechanisms subjected to reflected torque such as manufacturing equipment, machine tools, etc.

In the embodiments shown, inner surface 22 of sidewall 20 is shown in the drawings as a smooth and untextured surface. However, it is to be understood that inner surface 22 can be alternately configured, such as, for example by adding circumferencial grooves to the surface of various cross sectional shapes, such as for example, multiple "V" or "U" shaped grooves, to thereby increase or decrease corresponding effective friction forces.

In the embodiments shown, the actuator of the present invention includes three clutch arms. However, it is to be understood that the actuator of the present invention can be alternately configured to include a greater or lesser number of clutch arms.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. An actuator, comprising:

a cylinder having a central axis and a side wall, said side wall having an inner surface;

a clutch disposed within said cylinder, said clutch having a hub and at least one clutch arm, each of said at least one clutch arm including:

a negative opposing finger having a first end and a fingertip end, said first end hingedly attached to said hub, said fingertip end engaging said inner surface of said side wall;

a positive opposing finger having a first end and a fingertip end, said first end hingedly attached to said hub, said fingertip end engaging said inner surface of said side wall;

a negative opposing spring having a first end and a second end, said first end attached to said negative opposing finger;

a positive opposing spring having a first end and a second end, said first end attached to said positive opposing finger; and a control input, said control input configured for selectively engaging said second end of a selected one of said negative opposing spring and said positive opposing spring.

2. The actuator of claim 1, wherein said at least one clutch arm comprises at least two clutch arms.

3. The actuator of claim 1, wherein said at least one clutch arm comprises at least three clutch arms.

4. The actuator of claim 1, further comprising a control shaft, said hub attached to said control shaft.

5. The actuator of claim 4, wherein said hub is integral and monolithic with said control shaft.

6. The actuator of claim 5, wherein each of said at least one clutch arm is integral and monolithic with said hub.

7. The actuator of claim 1, wherein at least one of said negative opposing finger and said positive opposing finger is integral and monolithic with said hub.

8. The actuator of claim 1, wherein said negative opposing spring is integral and monolithic with said negative opposing finger and said positive opposing spring is integral and monolithic with said positive opposing finger.

9. The actuator of claim 1, further comprising a motor configured for selectively pivoting said control input relative to said central axis of said cylinder.

10. The actuator of claim 1, wherein said negative opposing finger engages said inner surface of said sidewall with a negative opposing frictionial force, said negative opposing frictional force being dependent at least in part upon said negative opposing angle and a negative opposing spring force applied by said negative opposing spring upon said negative opposing finger.

11. The actuator of claim 10, wherein said negative opposing spring force is reduced by pivotal movement of said control input away from said negative opposing spring to thereby reduce said negative opposing frictional force and enable pivoting of said clutch about said central axis.

12. The actuator of claim 1, wherein said positive opposing finger engages said inner surface of said sidewall with a positive opposing frictional force, said positive opposing frictional force being dependent at least in part upon said positive opposing angle and a positive opposing spring force applied by said positive opposing spring upon said positive opposing finger.

13. The actuator of claim 12, wherein said positive opposing spring force is reduced by pivotal movement of said control input away from said positive opposing spring to thereby reduce said positive opposing frictional force and enable pivoting of said clutch about said central axis.

14. A variable valve mechanism having an actuator, said actuator comprising:

a cylinder having a central axis and a side wall, said side wall having an inner surface;

a control shaft having a first end and a second end, the second end coupled to said variable valve mechanism; and a clutch disposed within said cylinder, said clutch having a hub and at least one clutch arm, each of said at least one clutch arm including:

a negative opposing finger having a first end and a fingertip end, said first end hingedly attached to said hub, said fingertip end engaging said inner surface of said side wall;

a positive opposing finger having a first end and a fingertip end, said first end hingedly attached to said hub, said fingertip end engaging said inner surface of said side wall;

a negative opposing spring having a first end and a second end, said first end attached to said negative opposing finger;

a positive opposing spring having a first end and a second end, said first end attached to said positive opposing finger; and a control input, said control input configured for selectively engaging said second end of a selected one of said negative opposing spring and said positive opposing spring.

15. The actuator of claim 14, wherein said at least one clutch arm comprises at least two clutch arms.

16. The actuator of claim 14, wherein said at least one clutch arm comprises at least three clutch arms.

17. A method of utilizing reflected torque imposed upon a control shaft to position the controlshaft in a desired angular position relative to a central axis thereof by selectively pivoting the control shaft in a desired direction relative to the central axis thereof, the reflected torque alternating between a negative and a positive direction, said method comprising the steps of:

establishing a negative opposing frictional force that is greater than the force resulting from the largest negative peak reflected torque value;

establishing a positive opposing frictional force that is greater than the force resulting from the largest positive peak reflected torque value;

coupling each of said negative opposing frictional force and said positive opposing frictional force to the control shaft to thereby preclude rotation of the control shaft due to the reflected torque; and reducing a selected one of said negative opposing frictional force and said positive opposing frictional force to thereby enable the reflected torque to impose a force exceeding the selected one of said negative opposing frictional force and said positive opposing frictional force to rotate the control shaft in a selected direction.

18. The method of claim 17, wherein said negative opposing frictional force includes, as a component thereof, a negative opposing spring force and said positive opposing frictional force includes, as a component thereof, a positive opposing spring force.

19. The method of claim 18, wherein said reducing step comprises reducing a selected one of said negative opposing spring force and said positive opposing spring force.

20. An internal combustion engine, comprising:

a variable valve mechanism; and an actuator coupled to said variable valve mechanism, said actuator including:

a cylinder having a central axis and a side wall, said side wall having an inner surface; and a clutch disposed within said cylinder, said clutch having a hub and at least one clutch arm, each of said at least one clutch arm including:

a negative opposing finger having a first end and a fingertip end, said first end hingedly attached to said hub, said fingertip end engaging said inner surface of said side wall;

a positive opposing finger having a first end and a fingertip end, said first end hingedly attached to said hub, said fingertip end engaging said inner surface of said side wall;

a negative opposing spring having a first end and a second end, said first end attached to said negative, opposing finger;

a positive opposing spring having a first end and a second end, said first end attached to said positive opposing finger; and a control input, said control input configured for selectively engaging said second end of a selected one of said negative opposing spring and said positive opposing spring.

* * * * *